US006716093B2

(12) United States Patent
Engdahl et al.

(10) Patent No.: US 6,716,093 B2
(45) Date of Patent: Apr. 6, 2004

(54) LOW FRICTION GIMBALED SUBSTRATE HOLDER FOR CMP APPARATUS

(75) Inventors: Erik H. Engdahl, Livermore, CA (US); Michael D. Steiman, Milpitas, CA (US); Paul H. Stasiewicz, Jr., Arvada, CO (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/013,429

(22) Filed: Dec. 7, 2001

(65) Prior Publication Data

US 2003/0109208 A1 Jun. 12, 2003

(51) Int. Cl.[7] ..... B24B 7/00
(52) U.S. Cl. ..... 451/287; 451/397
(58) Field of Search ..... 451/364, 379, 451/380, 397, 405, 276, 272, 259, 285, 287, 288

(56) References Cited

U.S. PATENT DOCUMENTS 3,698,776 A * 10/1972 Litman et al. ..... 384/126
4,270,314 A * 6/1981 Cesna ..... 451/288
5,081,795 A * 1/1992 Tanaka et al. ..... 451/288
5,377,451 A * 1/1995 Leoni et al. ..... 451/287
5,423,558 A * 6/1995 Koeth et al. ..... 279/3
5,593,344 A * 1/1997 Weldon et al. ..... 451/296
5,762,544 A * 6/1998 Zuniga et al. ..... 451/285
5,769,696 A * 6/1998 Lee et al. ..... 451/287
5,964,653 A * 10/1999 Perlov et al. ..... 451/288
6,077,155 A * 6/2000 Hayakawa et al. ..... 451/288
6,110,025 A * 8/2000 Williams et al. ..... 451/286
6,145,849 A * 11/2000 Bae et al. ..... 279/4.07
6,146,248 A * 11/2000 Jairath et al. ..... 451/41
6,277,010 B1 * 8/2001 Perlov et al. ..... 451/288
6,293,853 B1 * 9/2001 Perlov et al. ..... 451/56
6,379,235 B1 * 4/2002 Halley ..... 451/397
6,431,968 B1 * 8/2002 Chen et al. ..... 451/398
6,471,571 B2 * 10/2002 Oliver ..... 451/287
6,491,570 B1 * 12/2002 Sommer et al. ..... 451/41

* cited by examiner

*Primary Examiner*—Joseph J. Hail, III
*Assistant Examiner*—David B. Thomas
(74) *Attorney, Agent, or Firm*—Brinks Hofer Gilson & Lione

(57) ABSTRACT

An assembly for holding a substrate in a chemical mechanical planarization (CMP) apparatus is provided. The assembly includes a holder frame insertable into the chemical mechanical planarization apparatus, the holder frame having an inner wall. The assembly further includes at least one rolling mechanism rotatably mounted in the holder frame such that at least a portion of the rolling mechanism protrudes from the inner wall. The assembly also includes a wafer chuck movably mounted in the holder frame, the wafer chuck having a first side shaped to substantially conform to the inner wall and to be in continuous contact with the at least one rolling mechanism during planarization, and a second side adapted to receive a substrate for planarization. Also provided are an improved assembly for holding a substrate in a CMP apparatus and a method for reducing friction in a gimbaling mechanism of a wafer chuck in a wafer holder in a CMP apparatus during planarization.

25 Claims, 3 Drawing Sheets

LOW FRICTION GIMBALED SUBSTRATE HOLDER FOR CMP APPARATUS

FIELD OF THE INVENTION

This invention relates to a substrate holder for a chemical mechanical planarization (CMP) apparatus. More particularly, the present invention relates to a low friction, gimbaled wafer holder assembly for the planarization of substrates such as semiconductor wafers.

BACKGROUND

In a CMP apparatus, a substrate holder is typically used to hold a semiconductor wafer against a polishing pad during planarization. Certain known wafer holder assemblies use a ball joint so that the wafer holder can gimbal about a point during planarization. One such wafer holder assembly is disclosed in U.S. Pat. No. 5,593,344, hereby incorporated by reference in its entirety.

In one known ball joint wafer holder assembly, the wafer holder has a support frame that defines a hemispherical recess and a wafer chuck that comprises a hemispherical surface received within the hemispherical recess. Together, these two surfaces form a ball joint. One or both of the hemispherical surface and the hemispherical recess may have a fluid inlet connected to a source of fluid at a higher pressure, a fluid outlet connected to a fluid drain, and a bearing surface over which fluid flows from the source to the drain. The hemispherical surface is supported by the fluid over the bearing surface for rotation with respect to the support about a center of rotation during planarization.

Wafer holder assemblies employing ball joints may experience a performance degradation due to a friction force from the hemispherical surface of the wafer chuck rubbing against the hemispherical recess of the support frame during planarization. Accordingly, there is a need to develop a substrate holder assembly that experiences less friction than a ball joint-containing assembly during planarization.

SUMMARY OF THE INVENTION

In one aspect of the invention, an assembly for holding a substrate in a CMP apparatus is provided. The assembly comprises a holder frame insertable into the CMP apparatus, the holder frame having an inner wall. They assembly also includes at least one rolling mechanism rotatably mounted in the holder frame such that at least a portion of the rolling mechanism protrudes from the inner wall. The assembly further comprises a wafer chuck movably mounted in the holder frame, the wafer chuck having a first side shaped to substantially conform to the inner wall and to be in continuous contact with the at least one rolling mechanism during planarization, and a second side adapted to receive a substrate for planarization.

In another aspect of the invention, an assembly for holding a substrate in a CMP apparatus comprises a holder frame insertable into the CMP apparatus, the holder frame having an inner wall, the inner wall defining a substantially hemispherical recess. The assembly further includes a plurality of rolling mechanisms rotatably mounted in the holder frame such that at least a portion of each rolling mechanism protrudes from the inner wall. The assembly also includes a wafer chuck movably mounted in the holder frame, the wafer chuck having a first side shaped to substantially hemispherically and the first side being adapted to be in continuous contact each of the plurality of rolling mechanisms during planarization, and a second side adapted to receive a semiconductor wafer for planarization.

In yet another aspect of the invention, an improved wafer holder in a CMP apparatus is provided. The improvement comprises a gimbaling mechanism in the holder that permits gimbaling of a wafer chuck in a wafer holder frame during planarization substantially without a friction force caused by the wafer chuck rubbing against an inner wall of the wafer holder frame by providing at least one rolling mechanism rotatably mounted with the inner wall and protruding at least partially therefrom, wherein the wafer chuck contacts the rolling mechanism as the wafer chuck gimbals during planarization.

In still another aspect of the invention, a method of reducing friction in a gimbaling mechanism of a wafer chuck in a wafer holder in a CMP apparatus during planarization is provided. The method comprises (a) providing a wafer holder frame with an inner wall, the inner wall having at least one rolling mechanism rotatably mounted thereon, the rolling mechanism at least partially protruding from the inner wall; (b) movably mounting a wafer chuck in the wafer holder frame, the wafer chuck having a first side adapted to contact the at least one rolling mechanism and a second side adapted to receive a substrate for planarization; and (c) contacting the first side of the wafer chuck with the at least one rolling mechanism to provide gimbaling motion during planarization, thereby reducing the friction force cause by contacting the first side of the wafer chuck with the inner wall of the wafer holder.

The present invention provides the foregoing and other features, and the advantages of the invention will become further apparent from the following detailed description of the presently preferred embodiments, read in conjunction with the accompanying drawings. The detailed description and drawings are merely illustrative of the invention and do not limit the scope of the invention, which is defined by the appended claims and equivalents thereof.

DETAILED DESCRIPTION OF THE PREFERRED EMBODIMENTS

Figure 1:
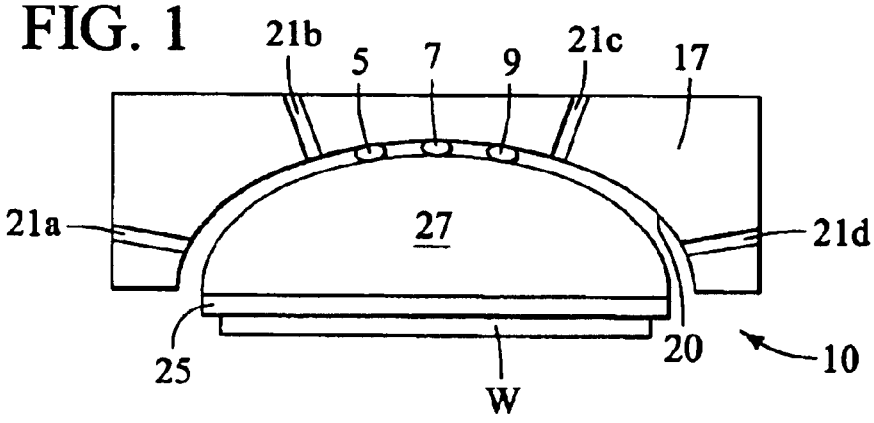
FIG. 1 is a cross-sectional view of a preferred substrate holder assembly for use in a CMP apparatus.

Referring to FIG. 1, a preferred substrate holding assembly 10 is shown. Substrate holding assembly 10 is adapted for use in a CMP apparatus, including linear polishing systems such as the TERES CMP system, available from Lam Research Corporation of Fremont, Calif. rotary polishing systems such as the MIRRA CMP system, available from Applied Materials of Santa Clara, Calif. and other suitable CMP systems known to those who are skilled in the art. The substrate holding assembly can be used to planarize semiconductor wafers W as well as silicon-on-insulator (SOI) surfaces, silicon-on-sapphire (SOS) surfaces and other surfaces that are fabricated on non-conductive carriers.

Substrate holding assembly 10 comprises a holder frame 17. Holder frame 17 can comprise any material typically used in semiconductor wafer holding frames in CMP apparatuses. Preferably, the holder frame 17 comprises Stainless Steel of Thermoplastic B19/20 Series. Holder frame 17 has an inner wall 20. In FIG. 1, the inner wall 20 defines a substantially hemispherical recess. However, the inner wall 20 can have any shape so long as the inner wall 20 substantially conforms to the shape of a first side of a wafer chuck 27.

A second side of the wafer chuck 27 is adapted to receive a substrate for planarization. Thus, the second side of the wafer chuck 27 is flat. Preferably, the second side of the wafer chuck 27 is shaped substantially like a disc. Optionally, the second side of wafer chuck 27 may have a carrier film 25.

The purpose of the carrier film 25 is to prevent the substrate to be planarized from moving around during planarization. The carrier film 25 can be any standard film used in semiconductor manufacturing and processing that is suitable for contacting the substrate to be planarized. Carrier films are typically made of polymeric material and commercially available from manufacturers of CMP auxiliary equipment, such as RODEL in Newark, Del. Preferably, the carrier film 25 is an oxide. The carrier film 25 may contain tungsten, copper, or aluminum. Carrier films and the process for attaching the carrier films to wafer chucks are described in U.S. Pat. No. 5,769,696, which is hereby incorporated by reference in its entirety.

Wafer chuck 27 may comprise any material typically used to make wafer chucks in CMP apparatuses. Preferably, the wafer chuck 27 comprises hardened stainless steel, which is commercially available through Rocklin Precision Machining of Rocklin, Calif.

Wafer chuck 27 may be supported in the holder frame 17 using any method known in the art, preferably a vacuum force. In FIG. 1, the holder frame 17 has fluid inlets 21*a* and 21*c* and fluid outlets 21*b* and 21*d*. The fluid inlets 21*a* and 21*c* are connected to a source of fluid at a higher pressure. The fluid outlets 21*b* and 21*d* are connected to a fluid drain at a lower pressure. Fluid flows from the source to the drain creating a bearing surface to minimize any friction force between the wafer chuck 27 and the inner wall 20 during planarization.

To further minimize any friction force between the first side of the wafer chuck 27 and the inner wall 20, as the wafer chuck 27 gimbals during planarization of the substrate, the first side of the wafer chuck 27 does not constantly rub a substantial portion of its entire surface against the inner wall 20. Instead, as the wafer chuck 27 gimbals, the first side of the wafer chuck 27 is in contact with at least one rolling mechanism that is mounted in the inner wall 20 rather than the inner wall 20 itself.

If there is more than one rolling mechanism mounted in the inner wall 20, the force of the wafer chuck 27 acting on the rolling mechanisms during planarization is preferably distributed evenly among each of the rolling mechanisms. This way, the first side of the wafer chuck 27 is in constant contact with only a few discrete rolling mechanisms, creating much less friction than if the entire surface of the first side of the wafer chuck 27 were in constant contact with almost the entire surface of the inner wall 20.

Figure 7:
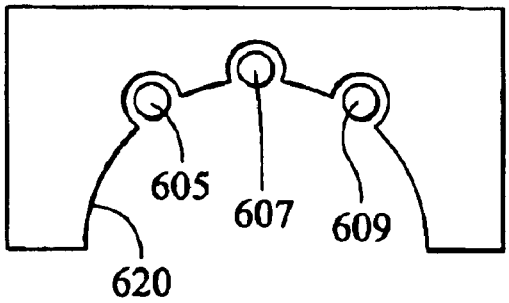
FIG. 7 is a cross-sectional view of a preferred substrate holder assembly for use in a CMP apparatus.

In FIG. 1, the inner wall 20 has rolling mechanisms 5, 7, and 9 mounted therein such that the rolling mechanisms 5, 7, and 9 protrude at least partially from the inner wall 20. In one preferred embodiment, rolling mechanisms 5, 7, and 9 are ball bearings that are supported in the inner wall 20. As shown in FIG. 7, ball bearings 605, 607, and 609 are supported in the inner wall 620 using holes that are formed into the inner wall 620, the holes being sized and shaped so that the ball bearings 605, 607, and 609 can protrude, at least partially, from the holes, but cannot fall from the holes. Preferred ball bearings are made of hardened stainless steel and are commercially available through King Bearing of San Jose, Calif.

Figure 8:
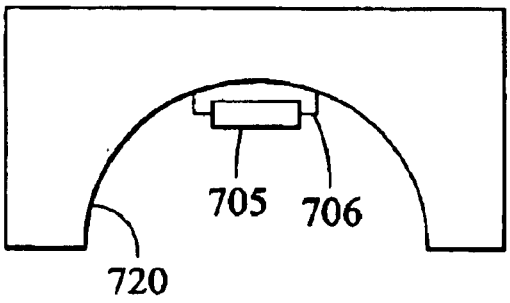
FIG. 8 is a cross-sectional view of a rolling mechanism mounted in a preferred holder frame.
Figure 9:
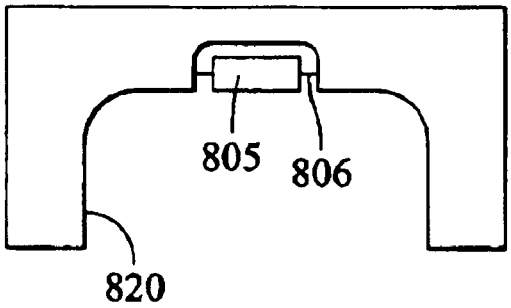
FIG. 9 is a cross-sectional view of a rolling mechanism mounted in a preferred holder frame.

In another preferred embodiment, rolling mechanisms 5, 7, and 9 are rollers supported in the inner wall 20 that protrude, at least partially, from the inner wall 20. As shown in FIGS. 8 and 9, rollers 705 and 805 are supported in the inner wall 720 and 820 using arms 706 and 806, respectively. They protrude at least partially from inner walls 720 and 820, respectively. The rollers 705 and 805 may rotate freely about their longitudinal axes. Preferred rollers 705 and 805 are commercially available through Bearing Engineers, Inc. of Redwood City, Calif.

Figure 2:
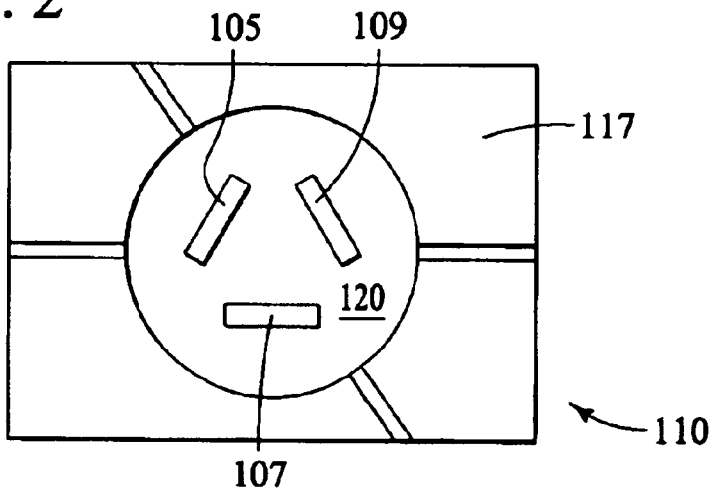
FIG. 2 is a bottom view of a preferred holder frame usable in a preferred substrate holder assembly.

Referring to FIG. 2, the rolling mechanisms in the holder frame 117 are rollers 105, 107, and 107. The rollers are mounted in inner wall 120, and protruding at least partially therefrom. Rollers 105, 107, and 107 are arranged end-to-end to outline the shape of a triangle. This way, the first side of the wafer chuck is in constant contact with rollers 105, 106, and 107 during planarization, and the wafer chuck is free to gimbal during planarization. Moreover, the force of the wafer chuck acting against the rollers is distributed evenly across each of rollers 105, 107, and 109. Importantly, the first side of the wafer chuck is not in constant contact with inner wall 120 as the wafer chuck gimbals during planarization, which reduces the amount of friction in the substrate holder assembly 110.

Figure 3:
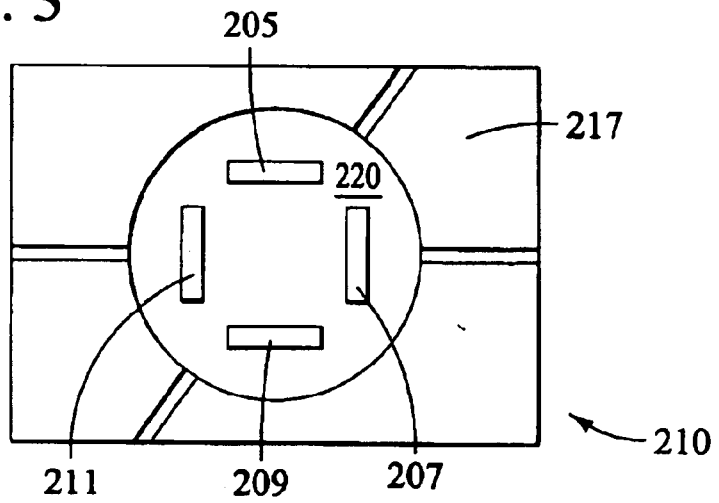
FIG. 3 is a bottom view of another preferred holder frame usable in a preferred substrate holder assembly.

Referring to FIG. 3, the rolling mechanisms in the holder frame 217 are rollers 205, 207, 209 and 211. The rollers are mounted in inner wall 220, and protruding at least partially therefrom. Rollers 205, 207, 209 and 211 are arranged end-to-end to outline the shape of a square. This way, the first side of the wafer chuck is in constant contact with rollers 205, 207, 209 and 211 during planarization, and the wafer chuck is free to gimbal during planarization. Moreover, the force of the wafer chuck acting against the rollers is distributed evenly across each of rollers 205, 207, 209 and 211. Importantly, the first side of the wafer chuck is not in constant contact with inner wall 220 as the wafer chuck gimbals during planarization, which reduces the amount of friction in the substrate holder assembly 210.

Figure 4:
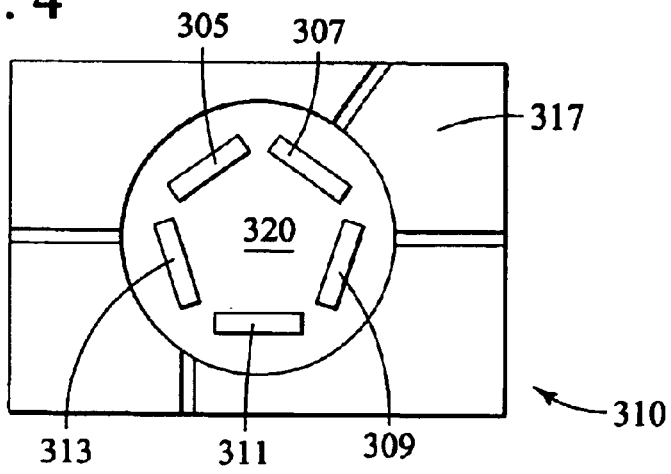
FIG. 4 is a bottom view of still another preferred holder frame usable in a preferred substrate holder assembly.

Referring to FIG. 4, the rolling mechanisms in the holder frame 317 are rollers 305, 307, 309, 311, and 313. The rollers are mounted in inner wall 220, and protruding at least partially therefrom. Rollers 305, 307, 309, 311, and 313 are arranged end-to-end to outline the shape of a pentagon. This way, the first side of the wafer chuck is in constant contact with rollers 305, 307, 309, 311, and 313 during planarization, and the wafer chuck is free to gimbal during planarization. Moreover, the force of the wafer chuck acting against the rollers is distributed evenly across each of rollers 305, 307, 309, 311, and 313. Importantly, the first side of the wafer chuck is not in constant contact with inner wall 320 as the wafer chuck gimbals during planarization, which reduces the amount of friction in the substrate holder assembly 310.

Figure 5:
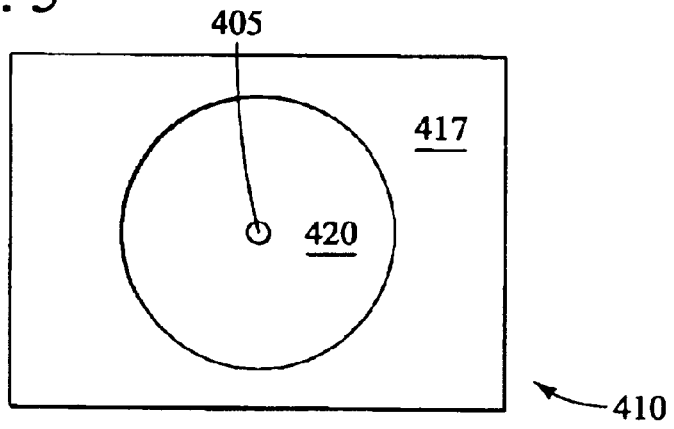
FIG. 5 is a bottom view of a preferred holder frame usable in a preferred substrate holder assembly.

Referring to FIG. 5, the rolling mechanism in the holder frame 417 is a single ball bearing 405. The ball bearing 405 is mounted in the frame so that it protrudes from the inner wall 420. This way, the first side of the wafer chuck is in constant contact with ball bearing 405 during planarization, and the wafer chuck is free to gimbal during planarization. Importantly, the first side of the wafer chuck is not in constant contact with inner wall 420 as the wafer chuck gimbals during planarization, which reduces the amount of friction in the substrate holder assembly 410.

Figure 6:
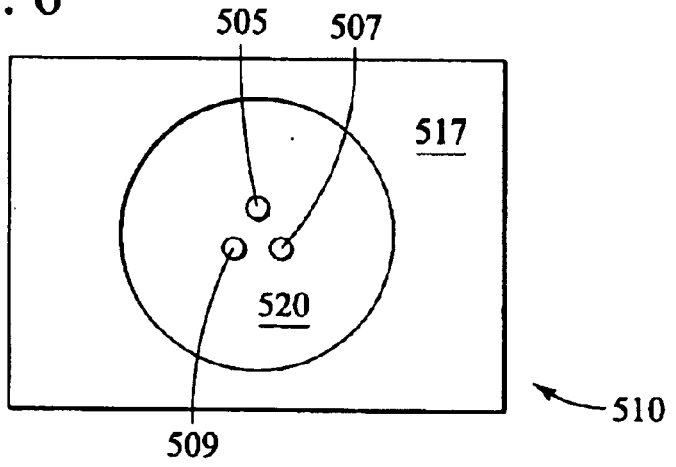
FIG. 6 is a bottom view of another preferred holder frame usable in a preferred substrate holder assembly.

Referring to FIG. 6, the rolling mechanisms in the holder frame 517 are ball bearings 505, 507, and 509. The ball bearings 505, 507, and 509 are mounted in the frame so that they protrude from the inner wall 520. This way, the first side of the wafer chuck is in constant contact with ball bearings 505, 507, and 509 during planarization, and the wafer chuck is free to gimbal during planarization. Moreover, the force of the wafer chuck acting against the ball bearings is distributed evenly across each of ball bearings 505, 507, and 509. Importantly, the first side of the wafer chuck is not in constant contact with inner wall 520 as the wafer chuck gimbals during planarization, which reduces the amount of friction in the substrate holder assembly 510.

Of course, it should be understood that a wide range of changes and modifications could be made to the preferred embodiments described above. For example, other fluids including gasses can be used in place of water. If desired the fluid bearings can be formed on the platen rather than the support, and the fluid inlet and outlet may be formed on different components. The hemispherical surfaces described above may depart from a true hemisphere to some extent, for example to provide self-centering forces. It is therefore intended that the foregoing detailed description be regarded as illustrative rather than limiting, and that it be understood that it is the following claims, including all equivalents, that are intended to define the scope of this invention.

What is claimed is:

1. An assembly for holding a substrate in a chemical mechanical planarization apparatus, the assembly comprising:

(a) a holder frame insertable into the chemical mechanical planarization apparatus, the holder frame having an inner wall with at least one hole formed in the inner wall;

(b) at least one rolling mechanism rotatably mounted in the holder frame such that only a portion of the rolling mechanism protrudes from the hole of the inner wall; and (c) a wafer chuck movably mounted in the holder frame, the wafer chuck having a first side shaped to substantially conform to the inner wall and to be in continuous contact with the at least one rolling mechanism during planarization, and a second side adapted to receive a substrate for planarization, wherein the continuous contact between the first side and the at least one rolling mechanism allows the wafer chuck to gimbal during planarization.

2. The assembly of claim 1 wherein the at least one rolling mechanism is one ball bearing.

3. The assembly of claim 1 wherein the at least one rolling mechanism comprises a plurality of ball bearings.

4. The assembly of claim 1 wherein the at least one rolling mechanism comprises a plurality of rollers adapted to rotate about their longitudinal axes.

5. The assembly of claim 1 wherein the at least one rolling mechanism comprises three rollers arranged end to end to outline a triangular shape.

6. The assembly of claim 1 wherein the at least one rolling mechanism comprises four rollers arranged end to end to outline a square shape.

7. The assembly of claim 1 wherein the at least one rolling mechanism comprises five rollers arranged end to end to outline a pentagonal shape.

8. The assembly of claim 1 wherein the first side of the wafer chuck is shaped substantially hemispherically and wherein the inner wall of the holder frame defines a substantially hemispherical recess.

9. The assembly of claim 1 wherein the second side of the wafer chuck is shaped like a disc.

10. The assembly of claim 1 wherein the second side of the wafer chuck comprises a carrier film.

11. The assembly of claim 10 wherein the carrier film comprises urethane.

12. The assembly of claim 10 wherein the carrier film is selected from the group consisting of RODEL DF 200 and RODEL R200.

13. The assembly of claim 1 wherein the substrate is a semiconductor wafer.

14. A chemical mechanical planarization apparatus comprising the assembly of claim 1.

15. An assembly for holding a substrate in a chemical mechanical planarization apparatus, the assembly comprising:

(a) a holder frame insertable into the chemical mechanical planarization apparatus, the holder frame having an inner wall, the inner wall defining a substantially hemispherical recess with at least one hole formed in the inner wall;

(b) a plurality of rolling mechanisms rotatably mounted in the holder frame such that only a portion of each rolling mechanism protrudes from the hole of the inner wall; and (c) a wafer chuck movably mounted in the holder frame, the wafer chuck having a first side shaped to substantially hemispherically and the first side being adapted to be in continuous contact each of the plurality of rolling mechanisms during planarization, and a second side adapted to receive a semiconductor wafer for planarization.

16. The assembly of claim 15 wherein the rolling mechanisms are ball bearings.

17. The assembly of claim 15 wherein the rolling mechanisms are rollers adapted to rotate about their longitudinal axes.

18. An improved wafer holder in a chemical mechanical planarization apparatus, the improvement comprising a gimbaling mechanism in the holder that permits gimbaling of a wafer chuck in a wafer holding frame during planarization substantially without a friction force caused by the wafer chuck rubbing against an inner wall of the wafer holding frame by providing at least one rolling mechanism rotatably mounted with the inner wall and protruding only partially therefrom, wherein contact between the wafer chuck and the at least one rolling mechanism allows the wafer chuck to gimbal during planarization.

19. The improvement of claim 18 wherein the at least one rolling mechanism is a plurality of ball bearings.

20. The improvement of claim 18 wherein the at least one rolling mechanism is a plurality of rollers adapted to rotate about their longitudinal axes.

21. A method of reducing friction in a gimbaling mechanism of a wafer chuck in a wafer holder in a chemical mechanical planarization apparatus during planarization, the method comprising:

(a) providing a wafer holder frame with an inner wall, the inner wall having at least one rolling mechanism rotatably mounted thereon, the rolling mechanism only partially protruding from the inner wall;

(b) movably mounting a wafer chuck in the wafer holder frame, the wafer chuck having a first side adapted to contact the at least one rolling mechanism and a second set adapted to receive a substrate for planarization; and (c) contacting the first side of the wafer chuck with the at least one rolling mechanism to provide gimbaling motion during planarization, thereby reducing the friction force cause by contacting the first side of the wafer chuck with the inner wall of the wafer holder.

22. The method of claim 21 wherein steps (b) and (c) are carried out simultaneously.

23. The method of claim 21 wherein the at least one rolling mechanism is a plurality of ball bearings.

24. The method of claim 21 wherein the at least one rolling mechanism is a plurality of rollers adapted to rotate about their longitudinal axes.

25. The assembly of claim 1, wherein the hole is sized and shaped so that the rolling mechanism does not fall from the hole.

* * * * *